United States Patent [19]

Vadas et al.

[11] 4,321,790

[45] Mar. 30, 1982

[54] PROCESS FOR INCREASING THE CAPACITY AND/OR ENERGETIC EFFICIENCY OF PRESSURE-INTENSIFYING STATIONS OF HYDROCARBON PIPELINES

[75] Inventors: Zoltán Vadas; Zoltán Belcsák; Ernö Lupták,

[73] Assignee: Energiagazdalkodasi Intezet, Budapest, Hungary

[21] Appl. No.: 89,387

[22] Filed: Oct. 30, 1979

[30] Foreign Application Priority Data

Oct. 31, 1978 [HU] Hungary ..... EE2597

[51] Int. Cl.[3] ..... F02C 3/22

[52] U.S. Cl. ..... 60/39.02; 60/39.18 B; 60/39.46 G

[58] Field of Search ..... 60/39.02, 39.07, 39.18 R, 60/39.18 B, 39.18 C, 39.46 G; 417/380, 381, 382

[56] References Cited

U.S. PATENT DOCUMENTS

| | | | |
|---|---|---|---|
| 3,104,524 | 9/1963 | Flanders | 60/39.46 G |
| 3,365,121 | 1/1968 | Phillips | 60/39.18 C |
| 3,420,054 | 1/1969 | Sheldon | 60/39.18 B |
| 3,505,811 | 4/1970 | Underwood | 60/39.18 B |

*Primary Examiner*—Louis J. Casaregola
*Attorney, Agent, or Firm*—Karl F. Ross

[57] ABSTRACT

The invention is used in the field of pressure-intensifying stations of natural gas and oil pipelines.

The essential character of the process according to the invention is that steam is produced in boilers heated with the outgoing flue gas of the gas turbines driving the compressors (pumps), the steam is conducted into steam turbine for driving further compressor(s), pump(s).

Main feature of the equipment according to the invention is that the ratio of the simultaneously operating gas turbines and steam turbines may vary from the equivalent to tripple value, the ratio is suitably double, and the stand-by machine unit is driven always by gas turbine, separate flue gas boiler is connected to each of the gas turbines, while the boilers are equipped with supplementary and/or substituting automatic heater.

Advantages of the invention include the following:

reduces the self-consumption by about ⅓rd,
improves safety of the pressure-intensification,
realizable in existing pressure-intensifying stations.

3 Claims, 2 Drawing Figures

PROCESS FOR INCREASING THE CAPACITY AND/OR ENERGETIC EFFICIENCY OF PRESSURE-INTENSIFYING STATIONS OF HYDROCARBON PIPELINES

FIELD OF THE INVENTION

Our present invention relates to the field of pressure-intensifying stations of natural-gas and oil pipelines.

BACKGROUND OF THE INVENTION

The large production sites for hydrocarbon (natural gas and oil) pipelines serving for the economical long-distance delivery of very large quantities of hydrocarbon. In the interest of economical investment and operation of the pipelines, pressure-intensifying stations are used by (e.g. at 100–150 km distance) which compensate the frictional and other resistance of the pipeline and (in case of natural gas) reduce the volume of the medium to be carried by keeping up the correct pressure.

A large number of pressure-intensifying stations are required by a pipeline several thousand km long. On worldwide scale this would amount to several thousand stations. Compressors (pumps) used in the pressure-intensifying stations are driven by power generators operated with the conveyed hydrocarbon. Thus, operation of a large number of pressure-intensifying stations—depending on the length of the pipeline—involves substantial consumption by the delivery system itself, thereby reducing the quantity of the salable hydrocarbon. The main reason for the high internal consumption is that gas turbines of the open circulation type are used nearly exclusively at the present for driving of the compressors (pumps), their energy efficiency being only 20–30%, so that 70–80% of the consumed hydrocarbon is not utilized. The known natural-gas pipeline of Orenburg may be mentioned as an example, along the whose 2800-km length 22 pressure-intensifying stations are operating with consumption of more than 15% (4.5 thousand million $m^3$/year) of the carried total natural-gas quantity.

OBJECTS OF THE INVENTION

Thus, our invention aims at reducing this loss of energy as far as possible. The object of our present invention, therefore, is to provide a process of and means for significantly improving the capacity and/or energy efficiency of the pressure-intensifying stations without the unfavorable alteration of other essential characteristics, such as safety of operation, independence from the surroundings, specific investment cost.

SUMMARY OF THE INVENTION

According to an essential feature of the invention steam is produced in the boilers heated with the outgoing flue gas of the gas turbines driving the compressors or pumps and the steam is conducted into the steam turbine for driving further compressors or pumps.

Main feature of the equipment according to the invention is that the ratio of the simultaneously cooperative gas turbines and steam turbines may vary from the equivalent to tripple value, suitably the ratio is double and the stand-by machine unit is always driven by a gas turbine, a separate flue gas boiler is connected with each of the gas turbines, and the boilers are equipped with a supplementary automatic heater.

In order to ensure independence from water for the pressure-intensifying station according to the invention, the steam turbines function with a closed air conditioning system; thus the minimal water requirement can be provided with storage and periodical supply. In the interest of the maintaining water quality and a low gas content in the closed system (boiler water supply) and to avoid the use of a large steam pipeline, the use of indirect air cooling is advantageous. When the small ribbed air cooler is under water pressure, any incidental leakages is recognizable. The mixing condenser of the cooling system is arranged suitably above and along the steam turbine so that the foundation of the steam turbine may be a simple flat base.

The process according to the invention solves the problem of cooling of the compressed and heated natural gas and lubricant of the machines, i.e. utilization of the compression and friction heat with heat exchangers built into the water supply system of the boilers.

With a small part of the steam produced in the flue gas boilers, heating of the natural gas to be expanded (to prevent water condensation) before the consumers of the pressure-intensifying stations is solved and separate boiler plant is unnecessary, thereby resulting in a saving of natural gas.

BRIEF DESCRIPTION OF THE DRAWING

A flow diagram of the process according to the invention is shown in FIG. 1.

SPECIFIC DESCRIPTION

Figure 1:
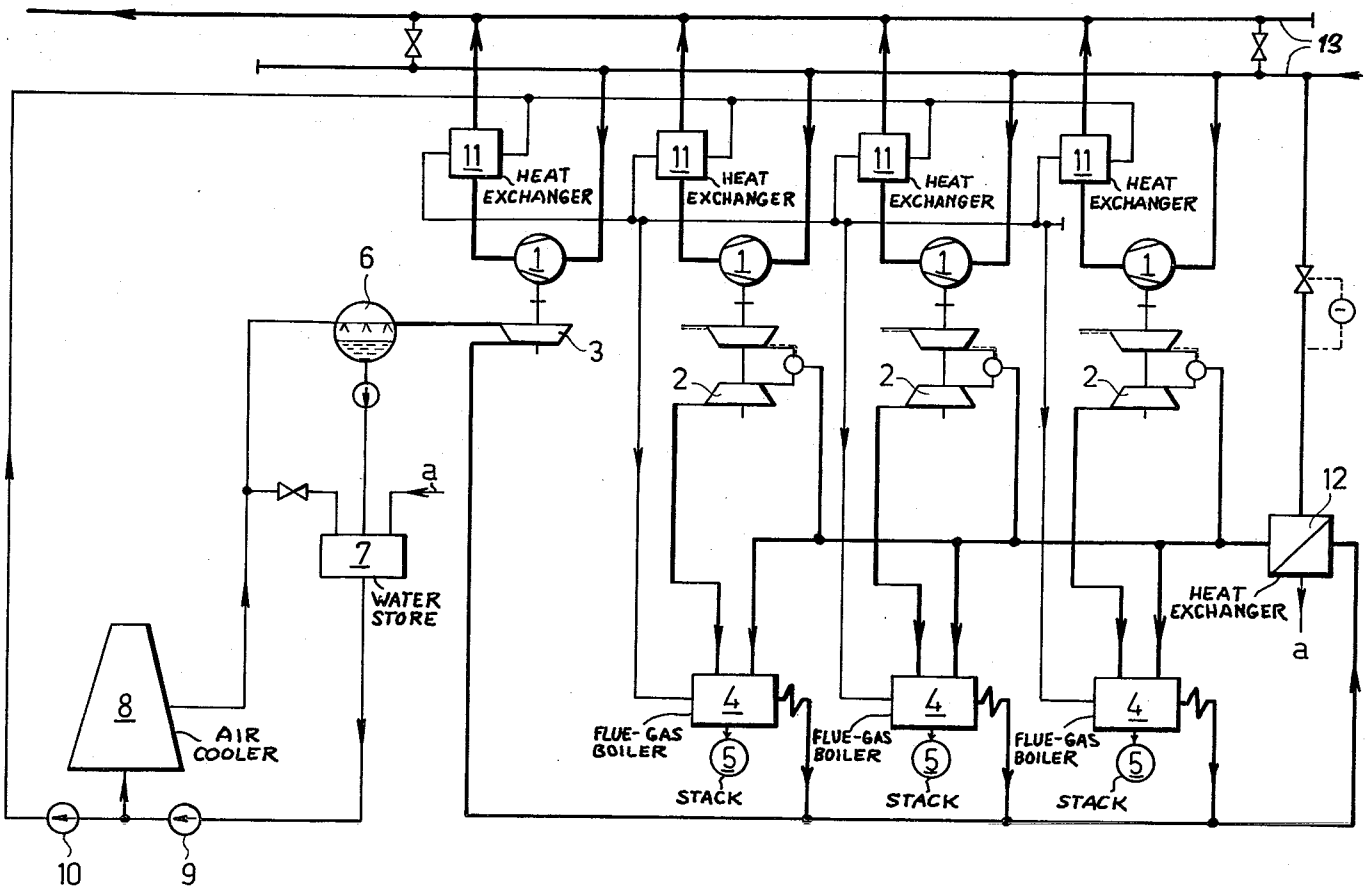

The two operating and one stand-by compressor units 1 shown in FIG. 1, are driven by gas turbines 2, while one operating unit is driven by the steam turbine 3. Steam for the steam turbine 3 is supplied by the flue gas boilers 4, two of them being operational while one is a stand-by unit. The flue gas boilers can be operated with supplementary natural gas heating or with substitute heating. The flue gas passes out of the flue gas boilers 4 through stacks 5 into the open. The indirect air conditioning system of the steam turbine includes the mixing condenser 6, atmospheric water storage 7, ventilator air cooler 8, and cooling water pump 9. Water supply to the flue gas boilers 4 is ensured from the closed air cooling system by pump 10. For cooling of the natural gas after compression, the water passes through heat exchangers 11. On the other hand with a small proportion of the produced steam the natural gas used for heating of the gas turbines 2 and boilers 4 is preheated prior to expansion with the aid of heat exchanger 12.

Figure 2:
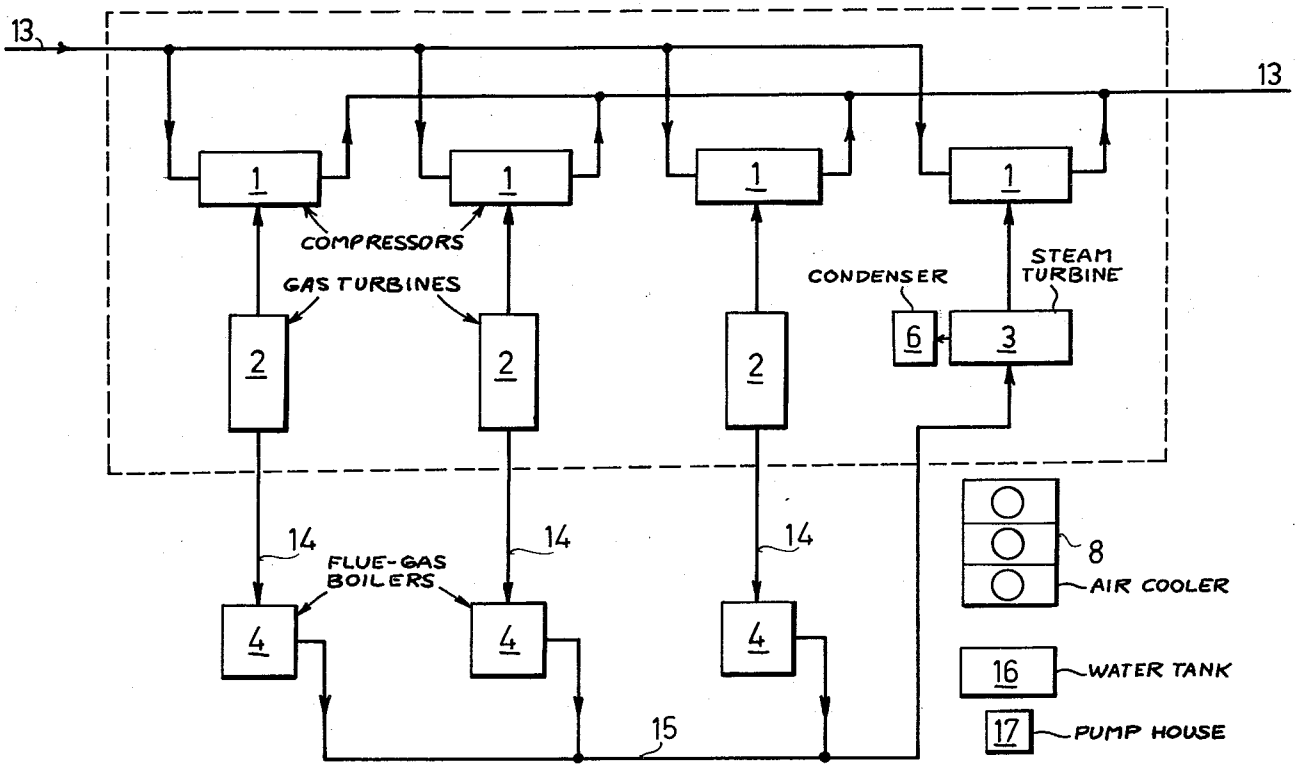
FIG. 2 is a block diagram of the layout of the pressure-intensifying station according to the invention.

The main apparatuses of the pressure-intensifying station according to the invention are shown in FIG. 2. The natural-gas pipeline 13 is connected with the pressure-intensifying compressors 1 on the inlet and outlet side, three of the compressors are driven by gas turbines 2, and one by the steam turbine 3. Flue gas of the gas turbines 2 passes to the flue gas boilers 4 through the flue gas ducts 14, the produced steam arrives at the steam turbine 3 through the steam collecting main pipe 15, the mixing condenser 6 is alongside the steam turbine 3, while the air cooler 8, the cooling water storage tank 16 and pump house 17 are shown farther.

Advantages of the invention includes the following:
reduces the self-consumption by about ⅓rd,
improves safety of the pressure intensification,
realizable in existing pressure-intensifying stations.

What we claim is:

1. A method of operating a pressure-intensifying station of a natural gas pipeline for increasing the capacity and energy efficiency thereof, said method comprising the steps of:

(a) producing by combustion a hot driving gas and propelling a gas turbine coupled with a machine for pressurizing the natural gas of said pipeline with said driving gas, thereby energetically depleting said driving gas and forming a flue gas therefrom;

(b) generating steam with said flue gas and propelling at least one steam turbine with the steam thus produced;

(c) driving a further machine for pressurizing said natural gas of said pipeline with said steam turbine;

(d) passing the natural gas after pressurization in said machines through at least one water-cooled heat exchanger; and (e) circulating water in a closed path through an air cooler, said heat exchanger, a steam condenser connected to said steam turbine, and a boiler in which the steam is generated in step (b) whereby water is heated in said heat exchanger prior to being transformed to steam in said boiler by the heat of the depleted gas from said gas turbine.

2. The method defined in claim 1 wherein said driving gas is produced by combustion of natural gas from said pipeline, said method further comprising the step of:

(f) heating the natural gas to be combusted in the formation of the driving gas by steam produced in said boiler.

3. The method defined in claim 2 wherein a plurality of gas turbines with respective compressors are provided for pressurizing the natural gas, each of said gas turbines having respective flue gas boiler, said method further comprising the step of:

(g) operating some of said gas turbines, compressors and flue gas boilers simultaneously in parallel while at least one gas turbine, compressor and flue gas boiler is provided in a stand-by mode.

* * * * *

UNITED STATES PATENT AND TRADEMARK OFFICE

CERTIFICATE OF CORRECTION

PATENT NO. : 4,321,790

DATED : 30 March 1982

INVENTOR(S) : Zoltán Vadas et al

It is certified that error appears in the above-identified patent and that said Letters Patent are hereby corrected as shown below:

In the heading, left column, item [75], after "Lupták," insert the following three inventors' names: -- György Pálfalvi, Vilmos Vasvári, Béla G. Wenzel --.

Signed and Sealed this

*Twenty-first* Day of *December 1982*

[SEAL]

*Attest:*

GERALD J. MOSSINGHOFF

*Attesting Officer*

*Commissioner of Patents and Trademarks*